US005238243A

United States Patent [19]

Grispi

[11] Patent Number: 5,238,243

[45] Date of Patent: Aug. 24, 1993

[54] HOCKEY TARGET APPARATUS

[76] Inventor: Richard M. Grispi, 126 Readville St., Readville, Mass. 02136

[21] Appl. No.: 872,849

[22] Filed: Apr. 23, 1992

[51] Int. Cl.[5] ..... A63B 69/00

[52] U.S. Cl. ..... 273/57.2; 273/389; 273/400

[58] Field of Search ..... 273/57.2, 398, 400, 273/401, 402, 411, 389

[56] References Cited

U.S. PATENT DOCUMENTS 3,840,228 10/1974 Greaney ..... 273/57.2
3,856,298 12/1974 Frantti ..... 273/57.2
3,887,181 6/1985 Samaras ..... 273/57.2
4,168,062 9/1979 McCarthy et al. ..... 273/57.2
4,489,940 12/1984 Amundson ..... 273/57.2
4,842,283 6/1989 Lebel et al. ..... 273/57.2 X

*Primary Examiner*—William H. Grieb
*Attorney, Agent, or Firm*—Leon Gilden

[57] ABSTRACT

A hockey target includes a vertical board having a plurality of openings. The openings are directed through the board into a receiving net cage rearwardly of the vertical board. The invention is further arranged to optionally include counter structure, whereupon projection of a target puck through one of said openings effects actuation of counter mechanism structure mounted to a side portion of the vertical board.

4 Claims, 4 Drawing Sheets

HOCKEY TARGET APPARATUS

BACKGROUND OF THE INVENTION

1. Field of the Invention

The field of invention relates to hockey practice apparatus, and more particularly pertains to a new and improved hockey target apparatus wherein the same is arranged to effect enhanced practice and accuracy in hockey target shooting.

2. Description of the Prior Art

Practice hockey games of various types are utilized throughout the prior art, wherein the use of target structure is available in U.S. Pat. No. 3,840,228 to Greaney wherein a goal tender target is mounted forwardly of a net structure to a unitary board member.

U.S. Pat. No. 4,489,940 to Amundson sets forth a practice goal tender for use in target practice of hockey game play and is arranged to provide for a goal tender simulation silhouette removably mounted relative to a rearwardly oriented target structure.

U.S. Pat. No. 4,168,062 to McCarthy, et al. sets forth a hockey goalie that is mechanized for movement to simulate a hockey goal tender.

As such, it may be appreciated that there continues to be a need for a new and improved hockey target apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of hockey game apparatus now present in the prior art, the present invention provides a hockey target apparatus wherein the same is arranged to provide for a hockey target having selective openings for directing practice hockey projectiles therethrough. As such, the general purpose of the present invention, which will be described subsequently in greater detail, is to provide a new and improved hockey target apparatus which has all the advantages of the prior art hockey game apparatus and none of the disadvantages.

To attain this, the present invention provides a hockey target including a vertical board having a plurality of openings. The openings are directed through the board into a receiving net cage rearwardly of the vertical board. The invention is further arranged to optionally include counter structure, whereupon projection of a target puck through one of said openings effects actuation of counter mechanism structure mounted to a side portion of the vertical board.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hockey target apparatus which has all the advantages of the prior art hockey game apparatus and none of the disadvantages.

It is another object of the present invention to provide a new and improved hockey target apparatus which may be easily and efficiently manufactured and marketed.

It is a further object of the present invention to provide a new and improved hockey target apparatus which is of a durable and reliable construction.

An even further object of the present invention is to provide a new and improved hockey target apparatus which is susceptible of a low cost of manufacture with regard to both materials and labor, and which accordingly is then susceptible of low prices of sale to the consuming public, thereby making such hockey target apparatus economically available to the buying public.

Still yet another object of the present invention is to provide a new and improved hockey target apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic rear view of the counter mechanism.

DESCRIPTION OF THE PREFERRED EMBODIMENT

Figure 2:
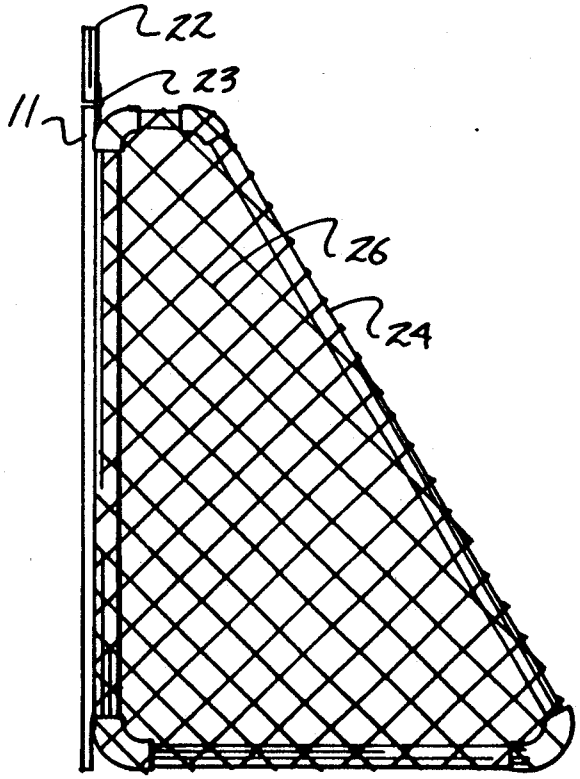
FIG. 2 is an orthographic side view of the instant invention.
Figure 1:
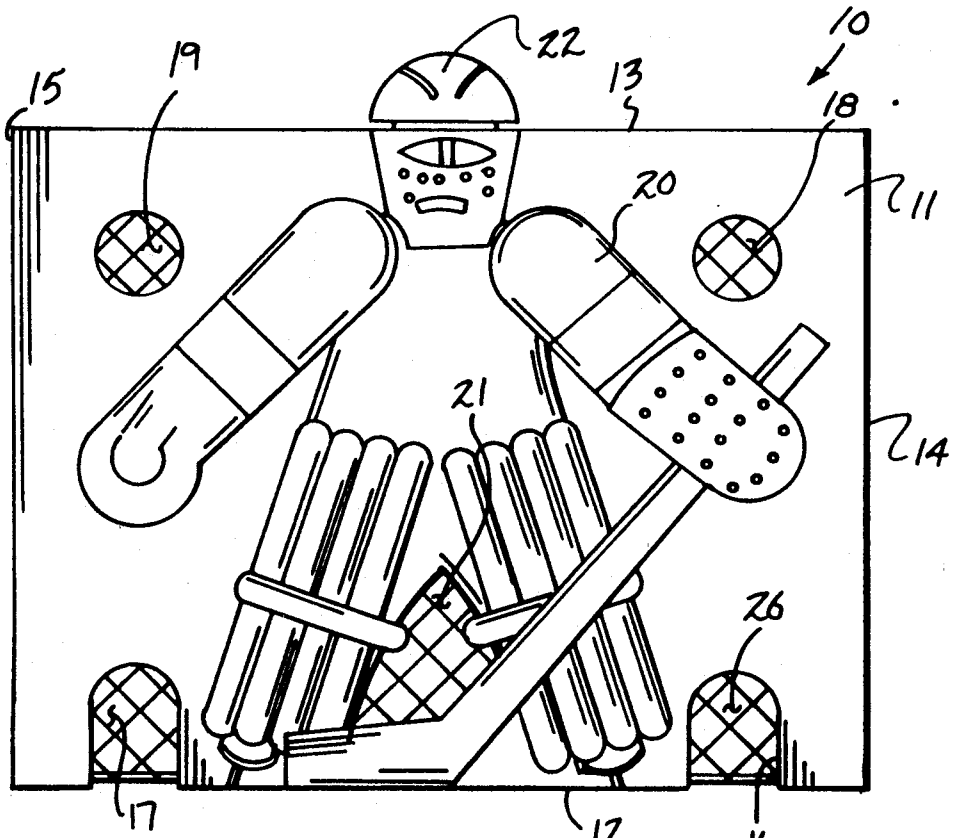
FIG. 1 is an orthographic view, taken in elevation, of the invention.
Figure 4:
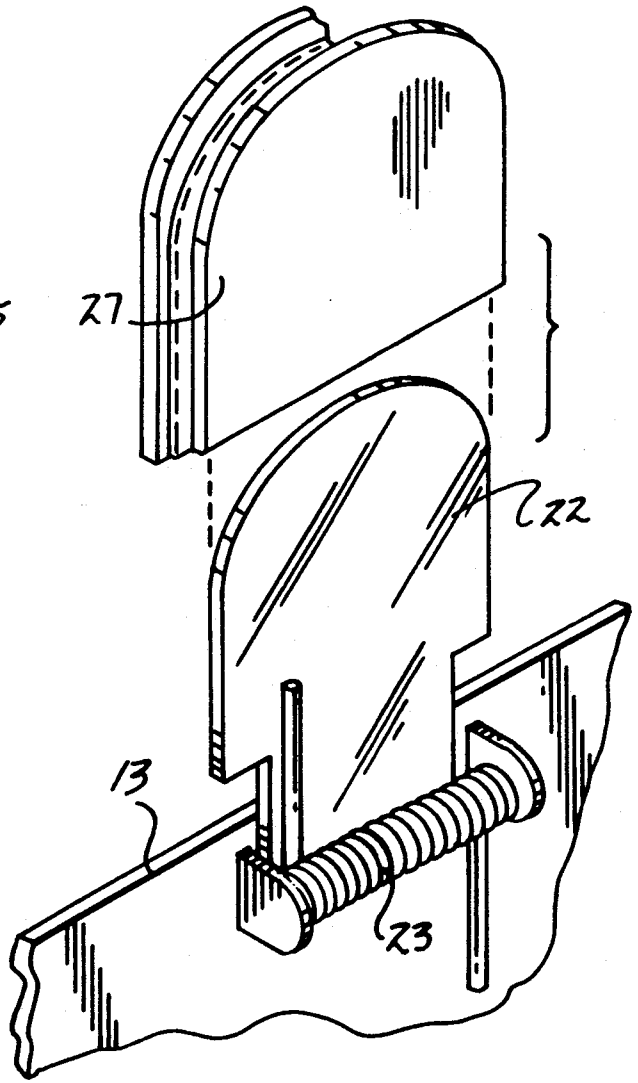
FIG. 4 is an isometric illustration of the target plate and associated cap structure.

With reference now to the drawings, and in particular to FIGS. 1 to 7 thereof, a new and improved hockey target apparatus embodying the principles and concepts of the present invention and generally designated by the reference numeral 10 will be described.

More specifically, the hockey target apparatus 10 of the instant invention essentially comprises a rigid vertical forward wall 11 having a lower edge 12 spaced from an upper edge 13, with a right side edge 14 spaced from a left side edge 15. Respective first and second openings 16 and 17 are directed through the forward wall 11 originating at the lower edge 12 and positioned respectively adjacent the right and left side edges 14 and 15. A third and fourth opening 18 and 19 positioned above the respective first and second openings 16 and 17 and positioned adjacent the upper edge 13 and adjacent the respective right and left side edges 14 and 15 are directed through the forward wall 11, in a manner as illustrated in the FIG. 1. A goal tender target 20 is positioned between the first through fourth openings 16–19, and includes a fifth opening 21 positioned within the goal tender target 20 and directed through the forward wall 11 between the first and second openings 16 and 17. A target plate 22 hingedly mounted about a spring hinge 23 medially of the upper edge 13 and to an upper portion of the goal tender target 20 is arranged to simulate a head portion of a goal tender and includes a removable pocket 27 arranged for receiving the rigid target plate 22 to permit the simulated helmet portion or pocket 27 to simulate various teams by logo and contrasting colorations.

Figure 3:
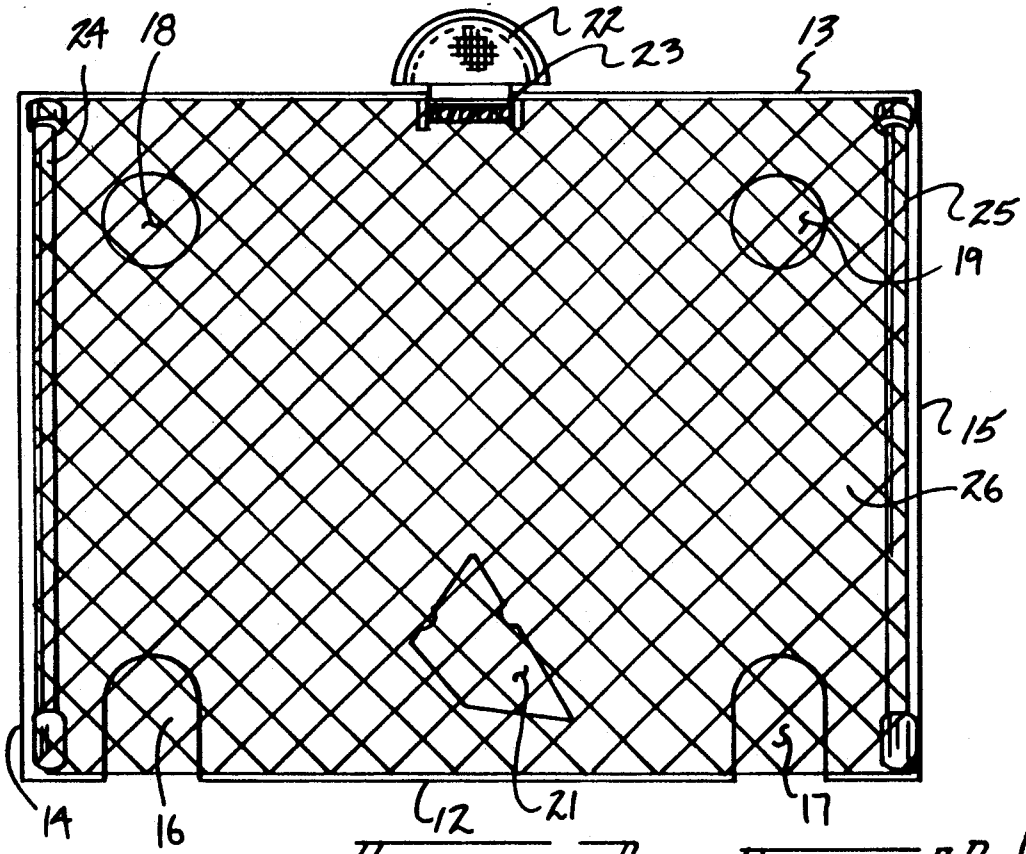
FIG. 3 is an orthographic rear view of the instant invention.
Figure 3:
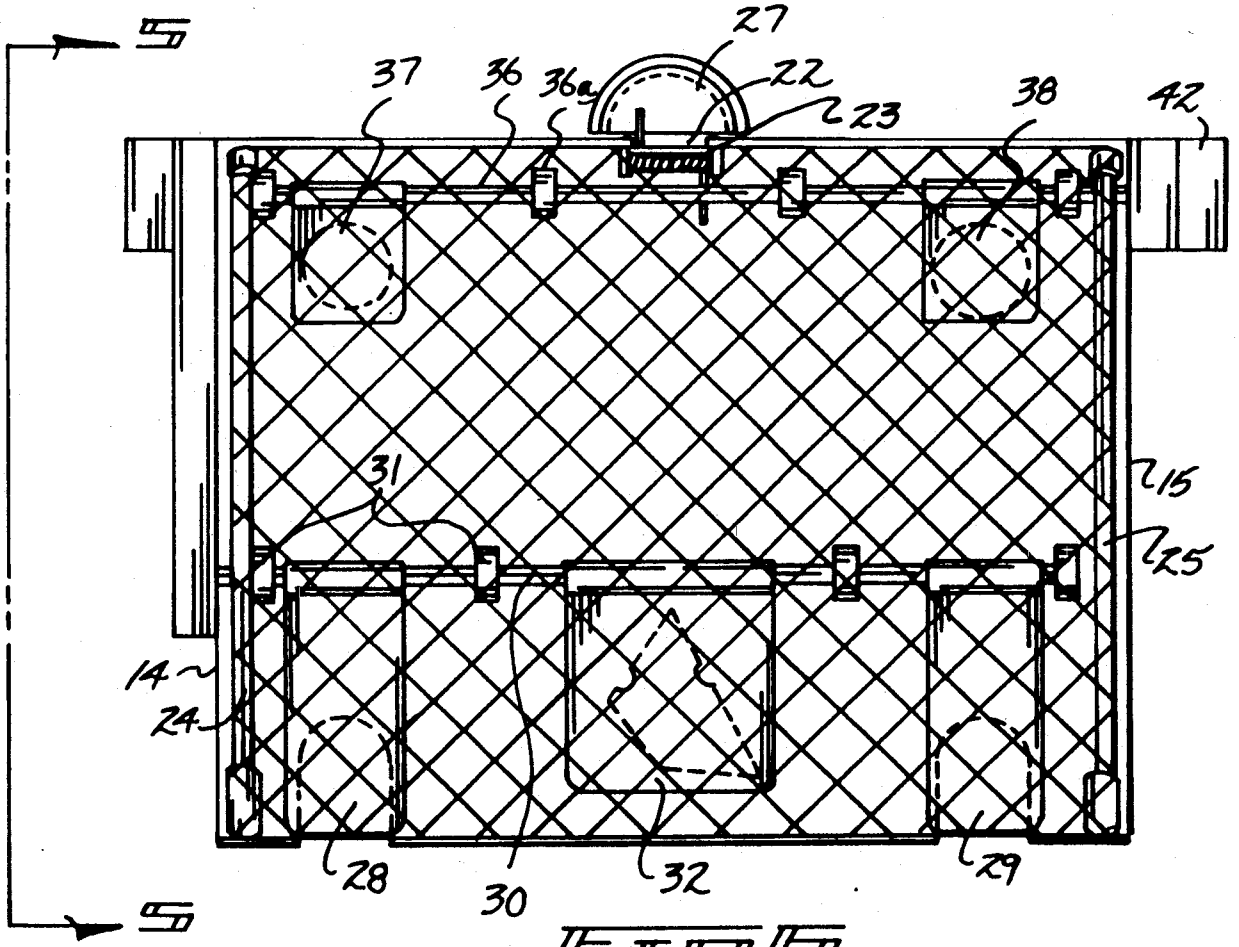

With respect to the FIGS. 2 and 3, respective right and left framework 24 and 25 are orthogonally mounted to the respective right and left side edges 14 and 15 relative to the vertical forward wall 11 and extend rearwardly of the forward wall and are defined by a predetermined height substantially equal to the predetermined height of the forward wall. A mesh web enclosure 26 extends in surrounding relationship relative to the right and left frameworks 24 and 25 from the right and left side edges 14 and 15 to the upper edge 13 in a surrounding relationship relative to the right and left frameworks defining a rear target pocket to receive targets directed through the openings 16–19 and 21. In this manner, various point totals may be awarded for directing projectiles, such as hockey pucks through the various openings in play of the game, with various point totals to be awarded or deducted relative to striking the target plate 22.

Figure 5:
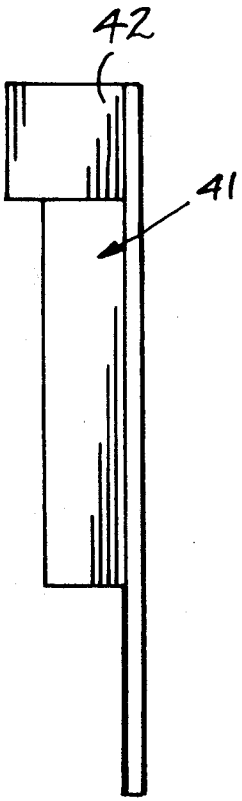
FIG. 5 is an orthographic side view of a modified aspect of the invention including a housing structure for a counter mechanism.
Figure 7:
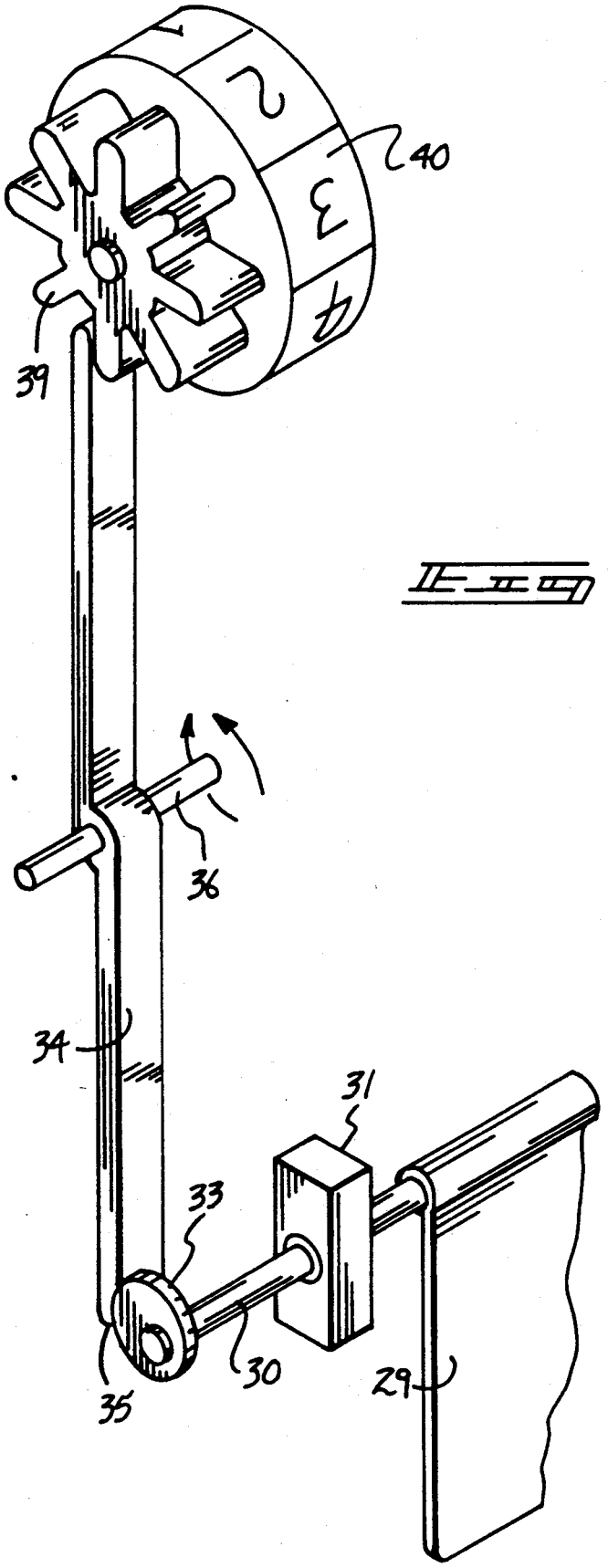
FIG. 7 is an isometric illustration of the hockey target plates of the counter mechanism arranged for mechanical association with the actuator lever structure.

The FIGS. 5–7 illustrate the use of a counter mechanism utilized in association with the accommodating of awarding point totals to projectiles directed through the various openings through the forward wall 11. To this end, a respective first and second target plate 28 and 29 are fixedly mounted at their upper distal ends to a first axle 30 that in turn is rotatably mounted within first bearing blocks 31. The first axle 30 is oriented parallel and above the lower edge 12 rearwardly of the forward wall 11 within the mesh web enclosure 26 having a fifth target plate 32 mounted fixedly at its upper distal end to the first axle 30. The first and second target plates 28 and 29 are positioned adjacent to and rearwardly of the respective first and second openings 16 and 17, with a fifth target plate positioned rearwardly of the fifth opening 21. It should be noted that the first axle 30 extends substantially coextensively between the right and left side edges 14 and 15 and includes at least one cam actuator defined by a first cam actuator 33 mounted to an outer distal end of the first axle 30. The first cam actuator 33 is arranged for engagement relative to a lower distal end of an actuator lever 34 that extends upwardly towards the upper edge 13 of the forward wall 11 rearwardly of the forward wall. The actuator lever 34 includes an actuator lever axle 36 positioned above and parallel the first axle 30 coextensive with the first axle 30 and rotatably mounted within the actuator lever axle bearings 36*a*. Respective third and fourth target plates 37 and 38 are mounted at their upper distal ends to the actuator lever axle 36 and these plates 37 and 38 are positioned rearwardly and adjacent the respective third and fourth openings 18 and 19. The actuator lever 34 then extends upwardly for engagement within a star wheel 39, whereupon pivotment of the actuator lever 34 about the actuator lever axle 36 effects rotation of the star wheel 39 and an associated digitally enumerated counter cylinder 40 fixedly mounted coaxially and adjacent the star wheel 39 and positioned within a counter housing 41, and more specifically within a counter housing cylinder housing 42 at an upper distal end of the counter housing 41. It should be noted that engagement of the actuator lever 34 by the first cam actuator 33 effects incremental pivotment of the actuator lever, whereupon directing the target through a third or fourth opening is arranged to effect a greater displacement pivotally of the actuator lever 34 to effect a point total of two for directing a target puck through a third or fourth opening, while a count total of one is directed through the first, second, and fifth openings. This is effected by rotation of the actuator lever axle 36 effecting a greater pivotment of an upper distal end of the actuator lever in engagement with the star wheel 39, then the first cam actuator 33 in engagement with the lower distal end.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hockey target apparatus, comprising, a vertical forward wall, the forward wall having a lower edge spaced from an upper edge, a right side edge spaced from a left side edge, and a forward surface spaced from a rear surface, and the forward wall having a first opening and a second opening directed through the forward wall adjacent the respective right and left side edges, with the first and second openings originating from the lower edge into the forward wall, and a respective third and fourth opening positioned above the respective first and second openings, with the third and fourth openings positioned adjacent the upper edge, with the third and fourth openings positioned adjacent the respective right and left side edges, and a goal tender target simulation mounted on the forward surface of the forward wall extending from the lower edge to the upper edge having a fifth opening positioned between the first opening and the second opening directed through the goal tender target, and a respective right and left framework fixedly and orthogonally mounted to the forward wall rear surface at the respective right and left side edges, and a mesh web enclosure extending from the right side edge to the left side edge in surrounding relationship about the right and left framework to define a pocket enclosure rearwardly of the vertical forward wall, with the mesh web extending to the upper edge, and the forward wall upper edge includes a target plate, the target plate having a spring hinge hingedly biasing the target plate in a coplanar relationship relative to the forward wall projecting above the forward wall, with the target plate mounted to an upper distal end of the goal tender target and the upper edge, and a removable pocket member receiving the target plate therewithin permitting varying team designations on the removable pocket.

2. An apparatus as set forth in claim 1 with a first axle mounted parallel to the rear surface of the forward wall and spaced above and adjacent the first opening and the second opening, with the first axle including first bearing blocks mounted to the rear surface rotatably mounting the first axle therethrough, the first axle extending from the right side edge, and a first target plate and a second target plate fixedly mounted at an upper distal end of the first target plate and an upper distal end of the second target plate to the first axle, with the first target plate positioned adjacent to and rearwardly of the first opening, the second target plate positioned rearwardly and adjacent the second opening, and a fifth target plate fixedly mounted to the first axle between the first target plate and the second plate, and a cam actuator mounted to the first axle adjacent the right side edge, and an actuator lever arranged in cooperation with the cam actuator, and a counter means in communication with the actuator lever for effecting sequential indication of pivotment of the first target plate, second target plate, and fifth target plate effecting rotation of the first axle.

3. An apparatus as set forth in claim 2 wherein the counter means includes a counter cylinder having digital spaces indicated circumferentially about the counter cylinder, and a star wheel coaxially and fixedly mounted to the counter cylinder, and an upper distal end of the actuator lever arranged in communication with the star wheel, whereupon displacement of the actuator lever by the cam actuator effects displacement of the star wheel and rotation of the counter cylinder.

4. An apparatus as set forth in claim 3 including an actuator lever axle directed through the actuator lever and fixedly mounted to the actuator lever medially of the actuator lever, with the actuator lever axle positioned above and parallel the first axle and above the third opening and the fourth opening, with a third target plate fixedly mounted to the actuator lever axle, with the third target plate positioned adjacent to the third opening rearwardly of the rear surface, and a fourth target plate fixedly mounted to the actuator lever positioned rearwardly and adjacent the fourth opening and adjacent the rear surface of the forward wall, whereupon directing a target through the one of said third or fourth target plates effects pivotment of the actuator lever axle and simultaneous rotation of said star wheel and said counter cylinder.

* * * * *